US009049922B2

(12) United States Patent
Schlueter

(10) Patent No.: US 9,049,922 B2
(45) Date of Patent: Jun. 9, 2015

(54) CABLE SUSPENSION SUPPORT ASSEMBLY

(76) Inventor: Donald David Schlueter, Detroit, MI (US)

( * ) Notice: Subject to any disclaimer, the term of this patent is extended or adjusted under 35 U.S.C. 154(b) by 213 days.

(21) Appl. No.: 13/521,363

(22) PCT Filed: Jan. 11, 2011

(86) PCT No.: PCT/US2011/020821

§ 371 (c)(1),
(2), (4) Date: Jul. 10, 2012

(87) PCT Pub. No.: WO2011/085364

PCT Pub. Date: Jul. 14, 2011

(65) Prior Publication Data

US 2012/0318946 A1 Dec. 20, 2012

Related U.S. Application Data

(60) Provisional application No. 61/335,740, filed on Jan. 11, 2010.

(51) Int. Cl.

| | |
|---|---|
| ***F16M 11/20*** | (2006.01) |
| ***A47B 7/00*** | (2006.01) |
| ***E04C 3/40*** | (2006.01) |
| *E04B 1/32* | (2006.01) |

(52) U.S. Cl.

CPC ..... *A47B 7/00* (2013.01); *A47B 2220/09* (2013.01); *E04B 1/32* (2013.01); *E04C 3/40* (2013.01)

(58) Field of Classification Search

CPC ..... E04C 3/40; A47B 21/00; E04B 1/32
USPC ..... 248/161, 560, 158, 175
See application file for complete search history.

(56) References Cited

U.S. PATENT DOCUMENTS

| | | | | | |
|---|---|---|---|---|---|
| 125,771 | A | * | 4/1872 | Trego | 52/651.02 |
| D182,037 | S | * | 2/1958 | Noguchi | D6/487 |
| 3,605,105 | A | * | 9/1971 | Penzias | 343/839 |
| 3,605,108 | A | * | 9/1971 | Crawford | 343/882 |
| 3,901,551 | A | | 8/1975 | Wiesner | |
| 3,936,109 | A | | 2/1976 | Richardson | |
| 4,657,116 | A | * | 4/1987 | Gardner et al. | 187/401 |
| 4,789,122 | A | | 12/1988 | Gutgsell | |
| 4,866,892 | A | | 9/1989 | Satoh et al. | |
| 5,832,688 | A | | 11/1998 | Crissey et al. | |
| D471,742 | S | * | 3/2003 | Muller | D6/488 |
| 6,901,714 | B2 | | 6/2005 | Liapi | |
| D534,382 | S | * | 1/2007 | Trott | D6/499 |
| 2003/0164633 | A1 | | 9/2003 | Jakus et al. | |
| 2004/0004166 | A1 | | 1/2004 | Dowd | |
| 2008/0016817 | A1 | | 1/2008 | Zeigler | |

* cited by examiner

*Primary Examiner* — Amy Sterling
(74) *Attorney, Agent, or Firm* — Miller Canfield

(57) ABSTRACT

A support assembly includes a first member, a second member spaced apart from the first member, a third member securing the first and second members together, and a fourth member extending between the first and second members. The fourth member forces the first and second members apart to provide a tensile force in the third member and a compressive force in the fourth member, thereby stabilizing the support.

23 Claims, 14 Drawing Sheets

CABLE SUSPENSION SUPPORT ASSEMBLY

BACKGROUND OF THE INVENTION

The present invention relates to a support assembly and more particularly to a table assembly having a compression member and a plurality of tension members.

SUMMARY OF THE INVENTION

According to one embodiment of the invention, a support assembly includes a first member, a second member that is separate and spaced apart from the first member, a third member that is fixedly secured to the first and second members, and a fourth member that extends linearly between the first and second members. A length of the fourth member is selectively adjustable. Increasing the length of the fourth member forces the first and second members apart to provide a tensile force in the third member and a compressive force in the fourth member, thereby stabilizing the support assembly.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF THE EMBODIMENTS

Figure 1:
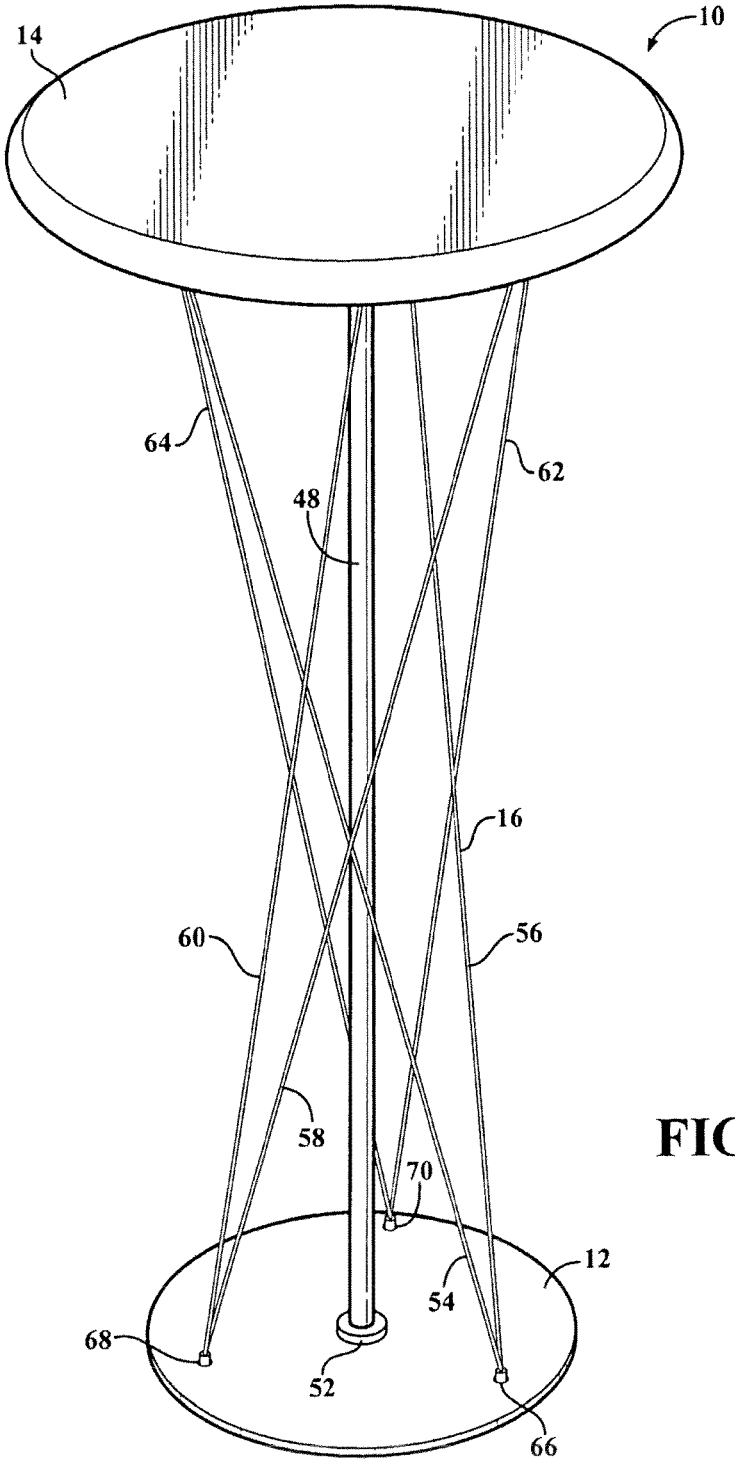
FIG. 1 is a perspective view of a three-point support assembly according to one embodiment of the invention.

Referring to the Figures, a support assembly is generally shown at 10. The support assembly 10 includes a minimal amount of components and can be assembled for use without the use of any tools. It is appreciated that the support assembly 10 will have any number of applications or uses such as a table, podium, structural truss, or display pedestal, to name just a few. Similarly, the support assembly 10 can be disassembled by removing a single component without the use of any tools. When the support assembly 10 is disassembled, it is very compact for shipping or transport, which makes the support assembly 10 easily portable.

The support assembly 10 includes a first member or base 12. Depending on the application, the first member 12 can be any of a variety of shapes. For example, when the support assembly 10 is used as a table or podium, the first member 12 commonly has a circular or rectangular shape. The first member 12 can be made from a variety of materials such as medium-density fiberboard (MDF), plywood, metal plate, molded plastic, or even recycled objects such as used automotive brake rotors.

A second member 14 is spaced apart from the first member 12, and similarly, can be any of a variety of shapes. For example, the second member 14 commonly has a circular, rectangular, or polygonal shape. In addition to the materials mentioned above with respect to the first member 12, the second member 14 can also be made from a variety of materials including tempered glass.

A third member 16 is provided to connect the first and second members 12, 14 together. The third member 16 can be any of a variety of components that are suitable for carrying a tensile load. In the embodiment shown, the third member 16 is a flexible cable that can be made from braided steel cable, rope, stretch cord, wire, chain or any similar flexible component. It is further appreciated that the third member 16 can be a generally rigid component that is capable of carrying a tensile load, such as a thin rod, for example. The cable 16 can be a single continuous element or a plurality of elements, as is described below. The cable 16 is secured to each of the first and second members 12, 14 at various connection locations generally adjacent the perimeter of each of the first and second members 12, 14.

Figure 2:
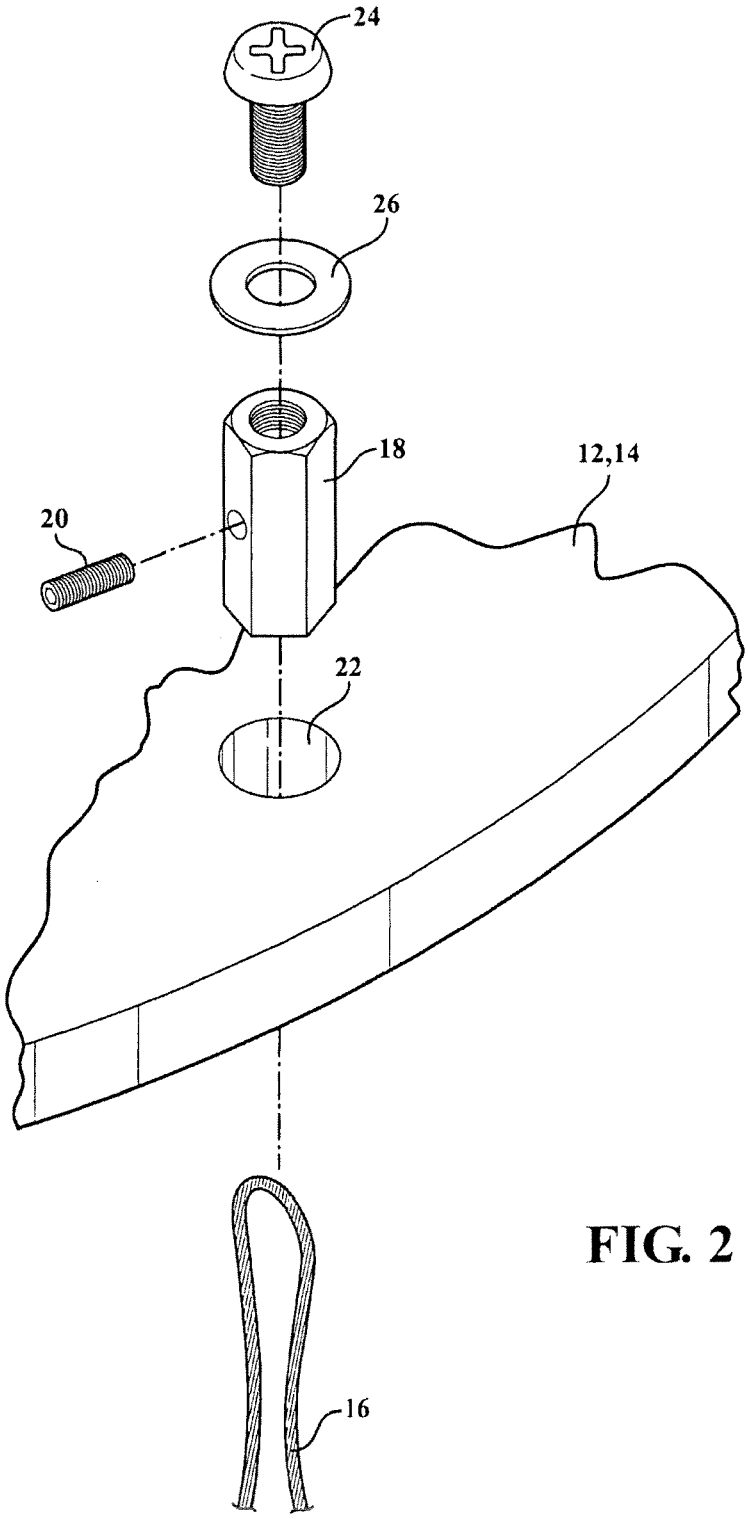
FIG. 2 is an exploded view of a first example of a connection location.

The cable 16 is fixedly secured to the first and second members 12, 14 by any of a variety of fastening devices. Referring to FIG. 2, for example, at each connection location the cable 16 is crimped and inserted into a coupling nut 18. A set screw or pin 20 is inserted through the coupling nut 18 to retain the crimped cable 16 therein. Alternatively, an epoxy compound may be used to retain the crimped cable 16 within the coupling nut 18. The coupling nut 18 is inserted into a hole 22 formed in one of the first or second members 12, 14 at each connection location. A connecting bolt 24 extends from an outer side of the first or second member 12, 14 through a washer 26 and is threadably secured into the coupling nut 18.

Figure 3:
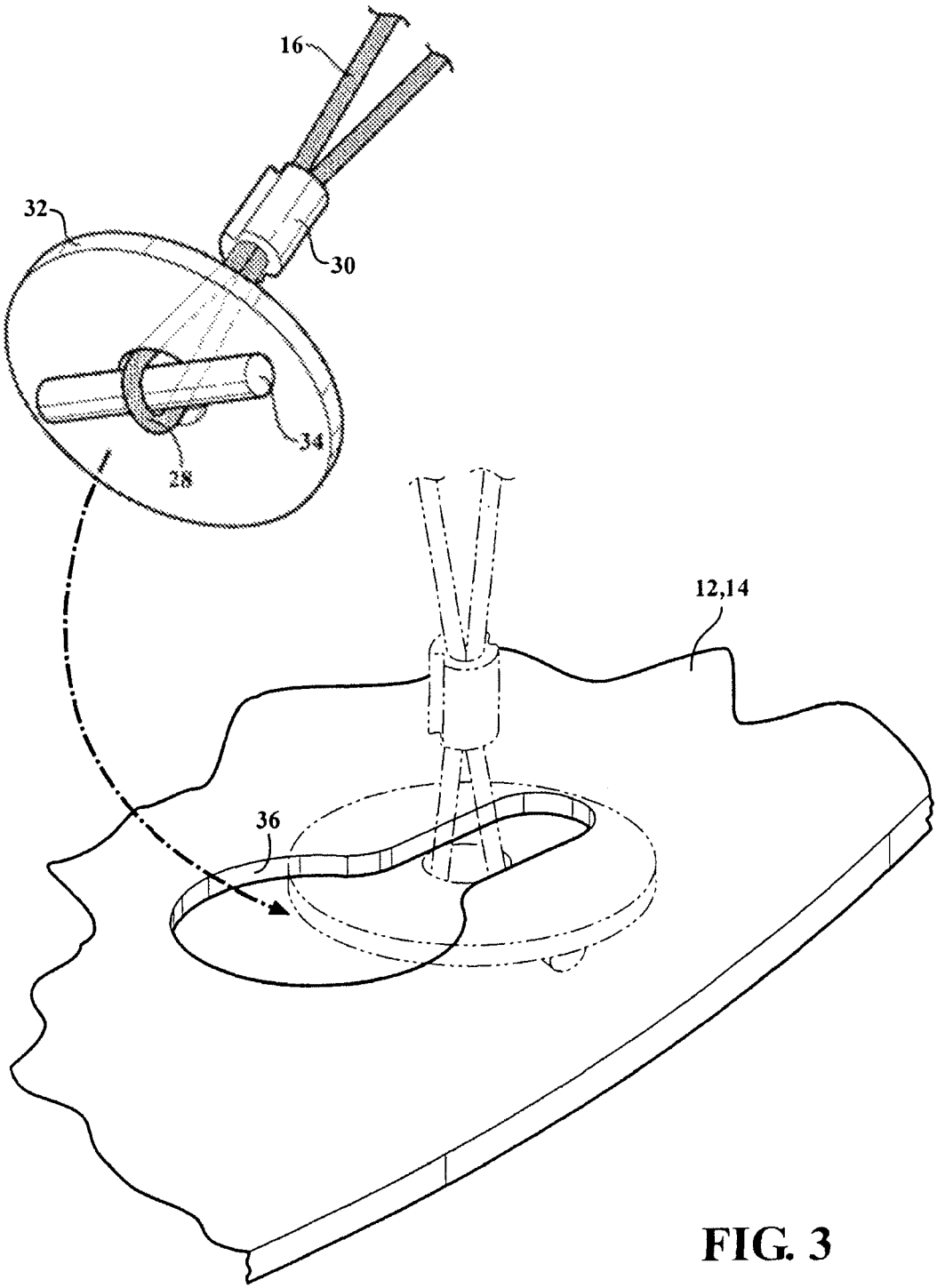
FIG. 3 is a partially exploded view of a second example of a connection location.

Other examples of fixedly securing the cable 16 to the first and second members 12, 14 are also contemplated. Referring to FIG. 3, for example, at each connection location the cable 16 is crimped and a loop 28 is formed by a swage fitting 30 securing adjacent cable sections together. Alternatively, when separate cables are used for each cable section, each cable section has a swage fitting 30 forming a loop 28. The loop or loops 28 are inserted through a washer 32 and retained with a pin 34. The washer 32 is inserted and retained in a blind key hole 36 formed on an inner side of the first or second member 12, 14. In other words, the key hole 36 does not extend through to the outer side of the first or second member 12, 14.

Figure 4:
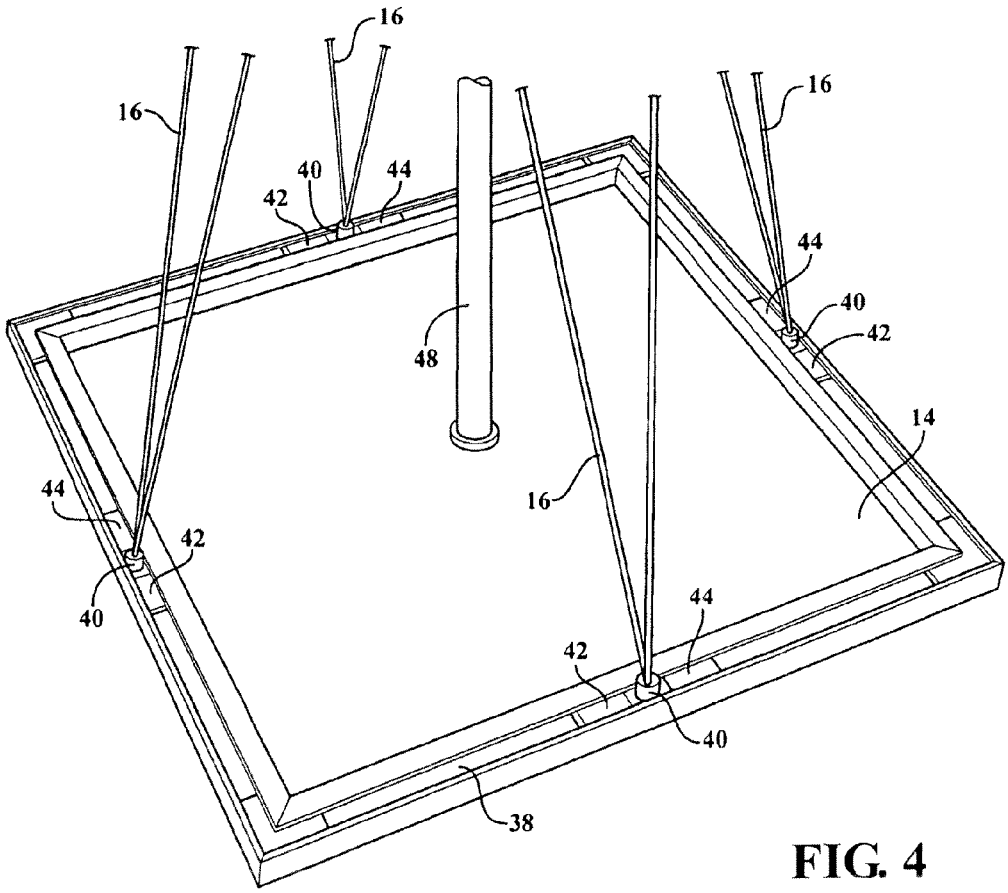
FIG. 4 is a bottom perspective view of a first member of the support assembly illustrating a third example of a connection location.
Figure 5:
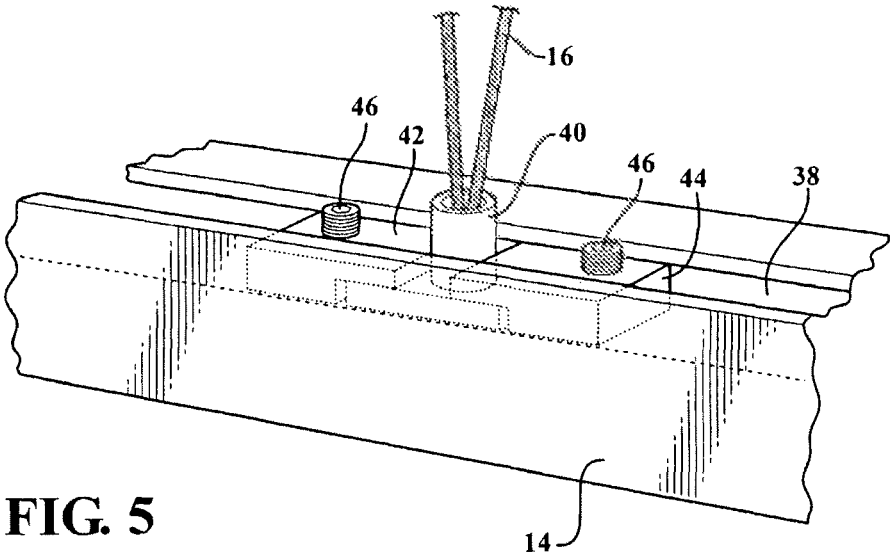
FIG. 5 is a close-up perspective view of the third example of the connection location.

Another example of fixedly securing the cable 16 to the second member 14 is contemplated wherein the inner side of the second member 14 includes a channel 38, as shown in FIGS. 4 and 5. The channel 38 is adapted for receiving a T-nut 40 therein. At each connection location the cable 16 is crimped and inserted into the T-nut 40 and retained with a pin (not shown). The T-nut 40 is secured in the channel 38 at each connection location by a pair of clips 42, 44 disposed on either side of the T-nut 40. The clips 42, 44 are fixedly secured within the channel 38 by tightening a set screw 46. It is appreciated that the cable 16 may be fixedly secured to the first member 12 in the same manner without varying from the scope of the invention.

A fourth member or post 48 extends linearly between the first and second members 12, 14. The post 48 engages an inner side of the first member 12 and an inner side of the second member 14 and applies an outward force to the first and second members 12, 14. Since the first and second members 12, 14 are connected by the cable 16, the cable 16 is subjected to a tensile load and the post 48 is subjected to a corresponding compressive load. The post 48 can be made from a variety of materials that are suitable for carrying the compressive load. As such, the post 48 is generally rigid and does not flex, however, it is contemplated that a certain amount of flex may be desirable. Further, the post 48 may be constructed of multiple elements that combine to form a single element. It is contemplated that the first and second members 12, 14 may include indents or some form of recess (not shown) for locating the ends of the post 48. The support assembly 10 may also include more than one post 48 extending between the first and second members 12, 14, as is described in more detail below. The tensile load in the cable 16 and the corresponding compressive load in the post 48 are controlled by the length of the post 48. If the post 48 has a fixed length, the post 48 is inserted between the first and second members 12, 14 and forces the first and second members 12, 14 apart to stabilize the support assembly 10. In order to disassemble the support assembly 10, the post or posts 48 are removed from between the first and second members 12, 14, allowing the cable 16 to collapse, thereby allowing the first and second members 12, 14 to be positioned directly adjacent each other.

Figure 6:
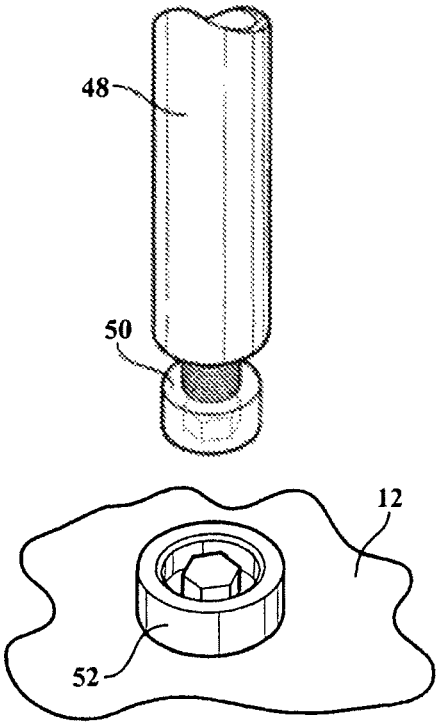
FIG. 6 is a partially exploded view of an adjustment mechanism.

If the post 48 has an adjustable length, the tensile load in the cable 16 and the corresponding compressive load in the post 48 increase as the length of the post 48 increases. The length of the post 48 can be adjusted using any of a variety of suitable methods. Referring to FIG. 6 for example, an adjustment mechanism includes a threaded bolt 50 threadably engaging one end of the post 48. A driver 52 for engaging the head of the threaded bolt 50 is fixedly secured to the first or second member 12, 14. In the embodiment shown, the driver 52 is fixedly secured to the first member 12. Thus, as the post 48 is rotated, in a counterclockwise direction for example, the post 48 rotates relative to the threaded bolt 50, thereby increasing the overall length of the post 48 until the support assembly 10 is sufficiently stable. It is contemplated that a cam-type device (not shown) could also be used to adjust the length of the post 48 without varying from the scope of the invention.

Figure 7:
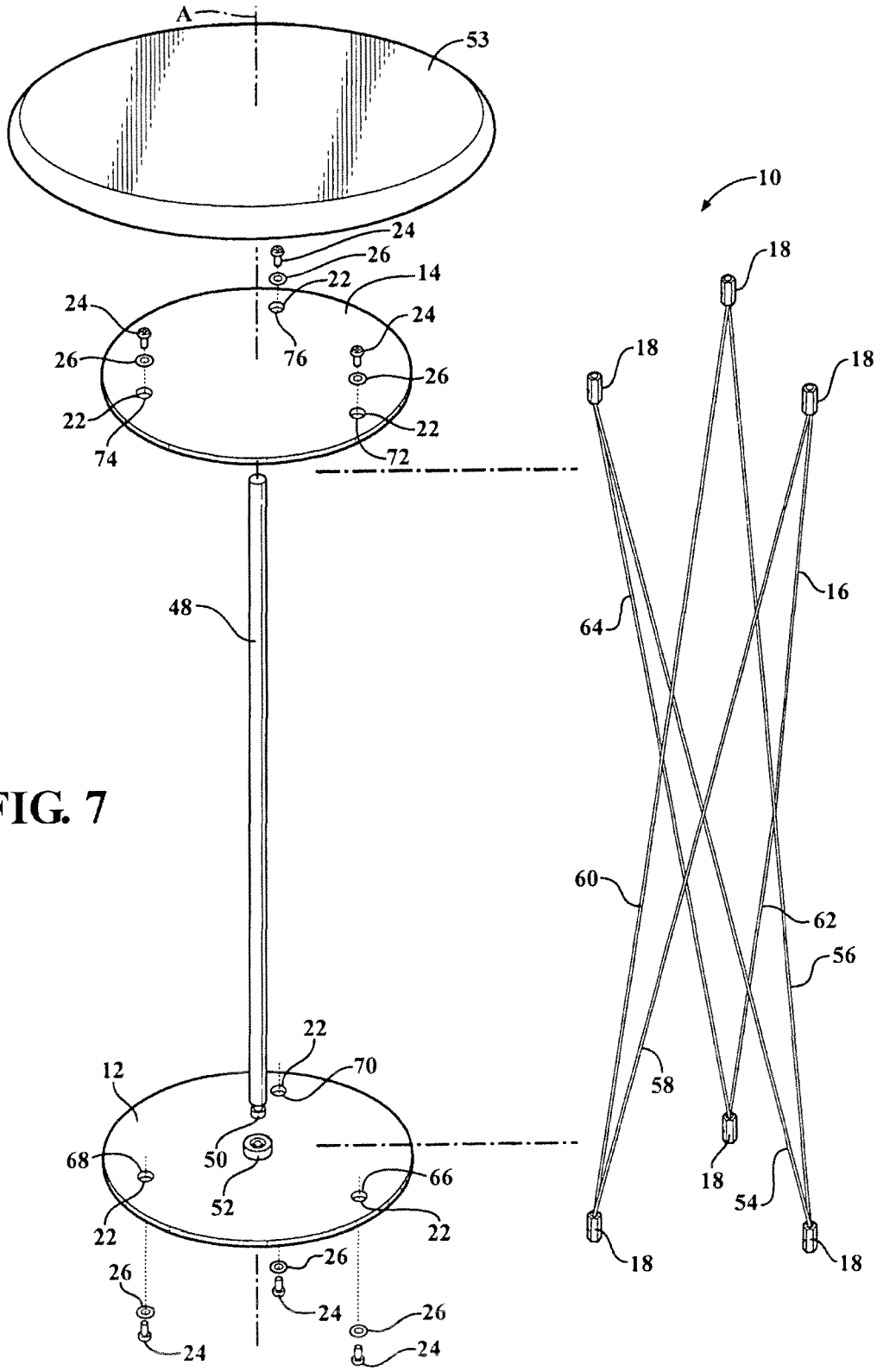
FIG. 7 is an exploded view of the three-point support assembly shown in FIG. 1.

It is contemplated that a secondary member or decorative top 53, shown in FIG. 7, can be placed over the second member 14 depending on the desired look of the support assembly 10. For example, when the support assembly 10 is to be used as a table, the decorative top 53 can be a table top having any particular design. The decorative top 53 is sized to fit over the second member 14 and will generally have larger overall dimensions than the second member 14. It is appreciated that the decorative top 53 may be fixedly secured to the second member 14.

Various embodiments of the support assembly 10 will now be described in detail. Referring to FIGS. 1 and 7, in a first embodiment of the invention, the support assembly 10 is a three-point system, wherein the cable 16 is connected to each of the first and second members 12, 14 at three separate points, thus creating six cable sections extending between the first and second members 12, 14 with two cable sections at each connection location. In other words, the cable 16 includes six cable sections, namely, a first cable section 54, a second cable section 56, a third cable section 58, a fourth cable section 60, a fifth cable section 62, and a sixth cable section 64. Each one of the six cable sections 54, 56, 58, 60, 62, 64 is equal in length such that the first and second 12, 14 members are generally parallel. It is appreciated that each cable section may be a separate cable without varying from the scope of the invention. It is further appreciated that the support assembly 10 may have any number of connection locations between the cable 16 and the first and second members 12, 14 without varying from the scope of the invention.

The first member 12 includes first, second and third connection locations 66, 68, 70. The first, second and third connection locations 66, 68, 70 are angularly spaced apart. More specifically, the first, second and third connection locations 66, 68, 70 are equally angularly spaced around a center point of the first member 12 such that adjacent connection locations are approximately one hundred and twenty (120) degrees apart. Similarly, the second member 14 includes fourth, fifth and sixth connection locations 72, 74, 76. The fourth, fifth and sixth connection locations 72, 74, 76 are also angularly spaced apart. More specifically, the fourth, fifth and sixth connection locations 72, 74, 76 are equally angularly spaced around a center point of the second member 14 such that adjacent connection locations are approximately one hundred and twenty (120) degrees apart.

Referring to FIG. 7, the post 48 extends between the first and second members 12, 14 and defines a first axis A that is centered relative to the first and second members 12, 14. The first and fourth connection locations 66, 72 are generally aligned. The second and fifth connection locations 68, 74 are generally aligned. The third and sixth connection locations 70, 76 are generally aligned. The first, second and third connection locations 66, 68, 70 on the first member 12 correspond with a circle having the first axis A at its center. Similarly, the fourth, fifth and sixth connection locations 72, 74, 76 on the second member 14 correspond with a circle also having the first axis A at its center.

Beginning with the first cable section 54, opposite ends are fixedly secured to the first and second members 12, 14 at the first and fifth connection locations 66, 74, respectively. Opposite ends of the second cable section 56 are fixedly secured to the first and second members 12, 14 at the first and sixth connection locations 66, 76, respectively. Opposite ends of the third cable section 58 are fixedly secured to the first and second members 12, 14 at the second and fourth connection locations 68, 72, respectively. Opposite ends of the fourth cable section 60 are fixedly secured to the first and second members 12, 14 at the second and sixth connection locations 68, 76, respectively. Opposite ends of the fifth cable section 62 are fixedly secured to the first and second members 12, 14 at the third and fourth connection locations 70, 72, respectively. Finally, opposite ends of the sixth cable section 64 are fixedly secured to the first and second members 12, 14 at the third and fifth connection locations 70, 74, respectively.

The arrangement of the connection locations 66, 68, 70, 72, 74, 76 is such that each cable section 54, 56, 58, 60, 62, 64 crosses by the post 48 as the cable sections 54, 56, 58, 60, 62, 64 extend between the first and second members 12, 14. Further, the cable sections 54, 56, 58, 60, 62, 64 form a triangulated pattern that is symmetrical about the first axis A and carry equal tensile loads evenly distributed around the respective perimeters of the first and second members 12, 14.

Figure 11:
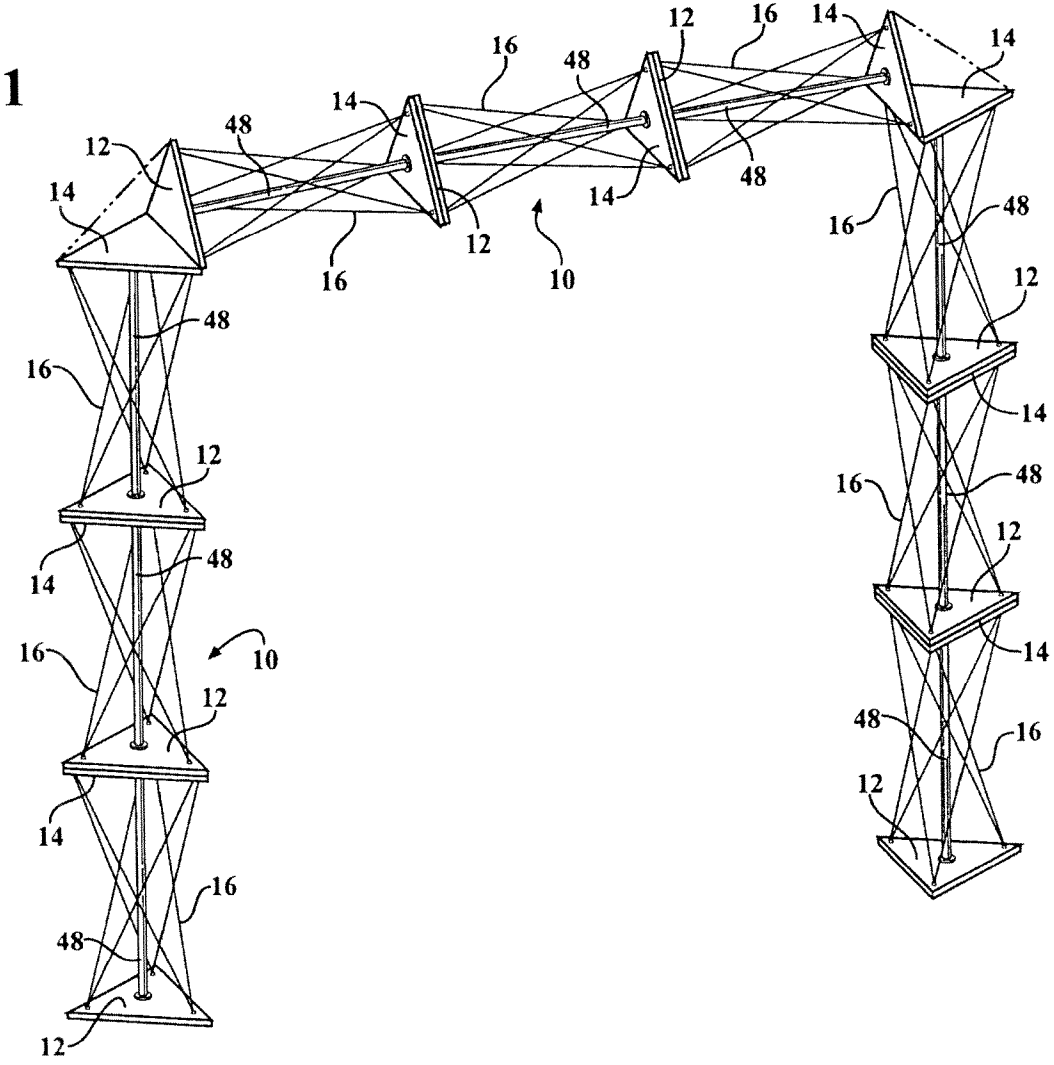
FIG. 11 is a perspective view illustrating a three-point support assembly used in a first truss-like system.

It is appreciated that more than one support assembly 10 can be arranged in an end-to-end configuration to construct a truss-like system having vertical and/or horizontal members, as shown in FIG. 11.

Figure 12:
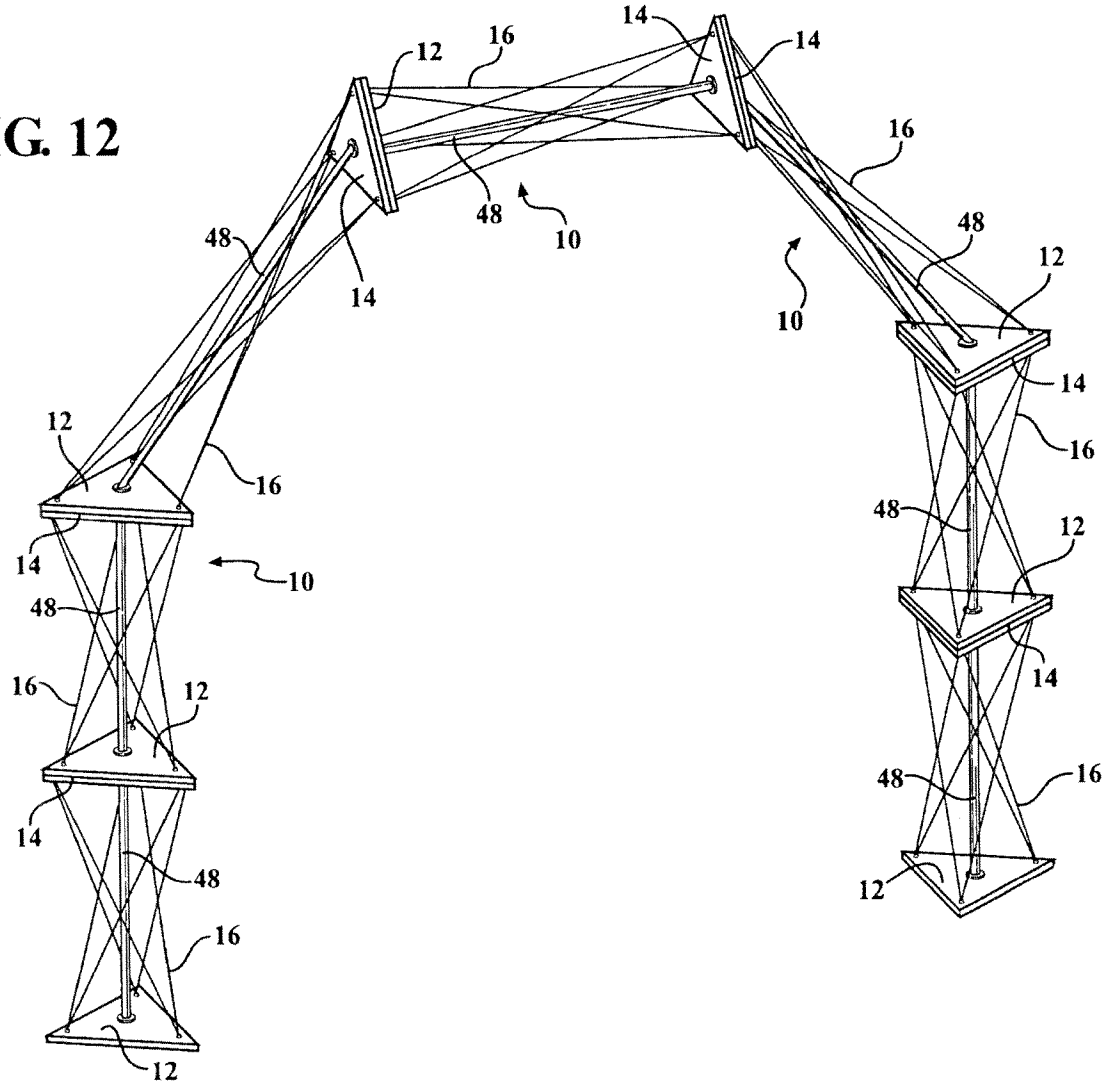
FIG. 12 is a perspective view illustrating a three-point support assembly used in a second truss-like system.

It is also appreciated that having cable sections of unequal lengths will result in the first and second members 12, 14 being non-parallel when the post 48 is extended therebetween. For example, if the second and fourth cable sections 56, 60, which are both fixedly secured to the second member 14 at the sixth connection location 76, have equal lengths but are longer than the first, third, fifth and sixth cable sections 54, 58, 62, 64, the second member 14 will be non-parallel with the first member 12. In this arrangement, the first member 12 is generally perpendicular with the post 48 and the second member 14 is non-perpendicular with the post 48. Other cable sections can be lengthened or shortened, as required, to vary the orientation of the first and second members 12, 14. It is contemplated that the post 48 extending between the non-parallel first and second members 12, 14 will have ends adapted for engaging the inner sides of the non-parallel first and second members 12, 14. One example of the support assembly 10 having non-parallel first and second members 12, 14 is shown in FIG. 12, wherein the support assembly 10 is used as an angled section in the truss-like system.

Figure 8:
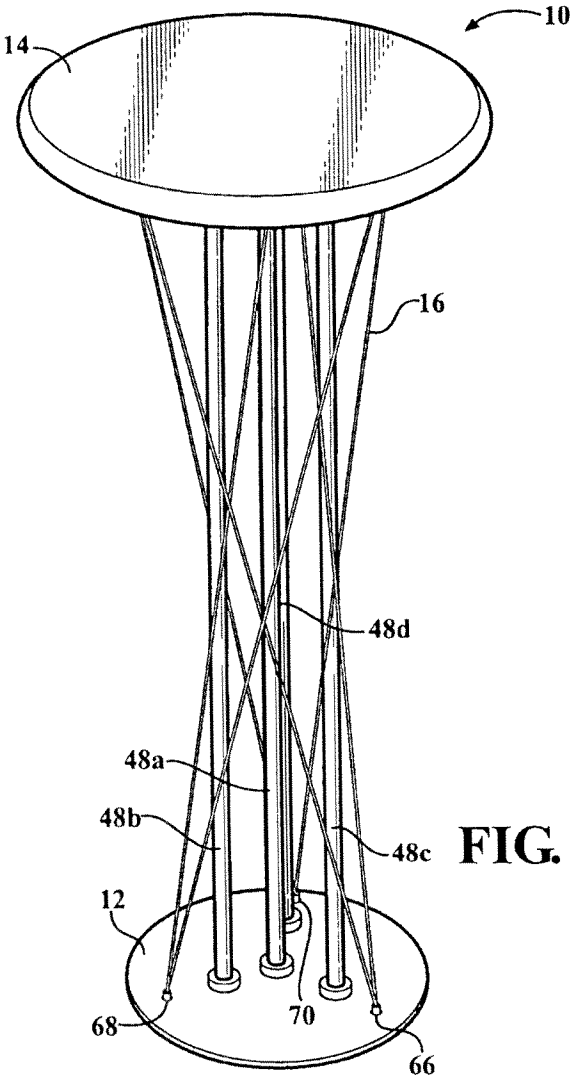
FIG. 8 is a perspective view of a first alternative arrangement of the three-point support assembly shown in FIG. 1.

In a first alternative arrangement of the three-point support assembly 10, shown in FIG. 8, the support assembly 10 includes four posts 48*a*, 48*b*, 48*c*, 48*d* that extend generally parallel between the first and second members 12, 14. One post 48*a* is centered relative to the first and second members 12, 14. The other three posts 48*b*, 48*c*, 48*d* are disposed symmetrically around the centered post 48*a* such that the other posts 48*b*, 48*c*, 48*d* correspond with a circle having the centered post 48*a* at its center. It is appreciated that the centered post 48*a* could be removed or that additional posts 48 could be provided without varying from the scope of the invention.

Figure 9:
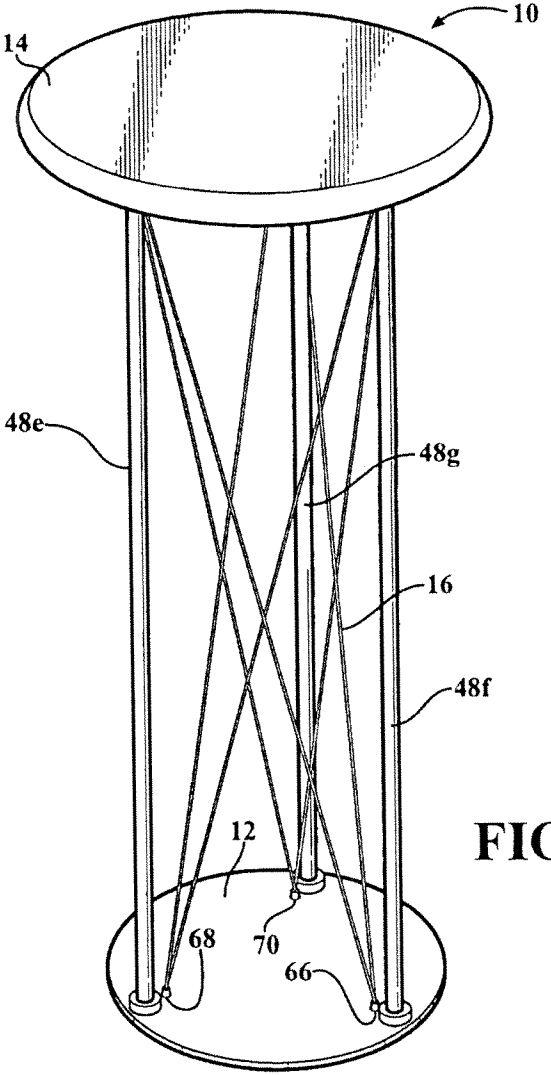
FIG. 9 is a perspective view of a second alternative arrangement of the three-point support assembly shown in FIG. 1.

In a second alternative arrangement of the three-point support assembly 10, shown in FIG. 9, the support assembly 10 includes three posts 48*e*, 48*f*, 48*g* that extend generally parallel between the first and second members 12, 14. Each post 48*e*, 48*f*, 48*g* is located circumferentially outside the first, second and third connection locations 66, 68, 70 on the first member 12 and the fourth, fifth and sixth connection locations 72, 74, 76 on the second member 14.

Figure 10:
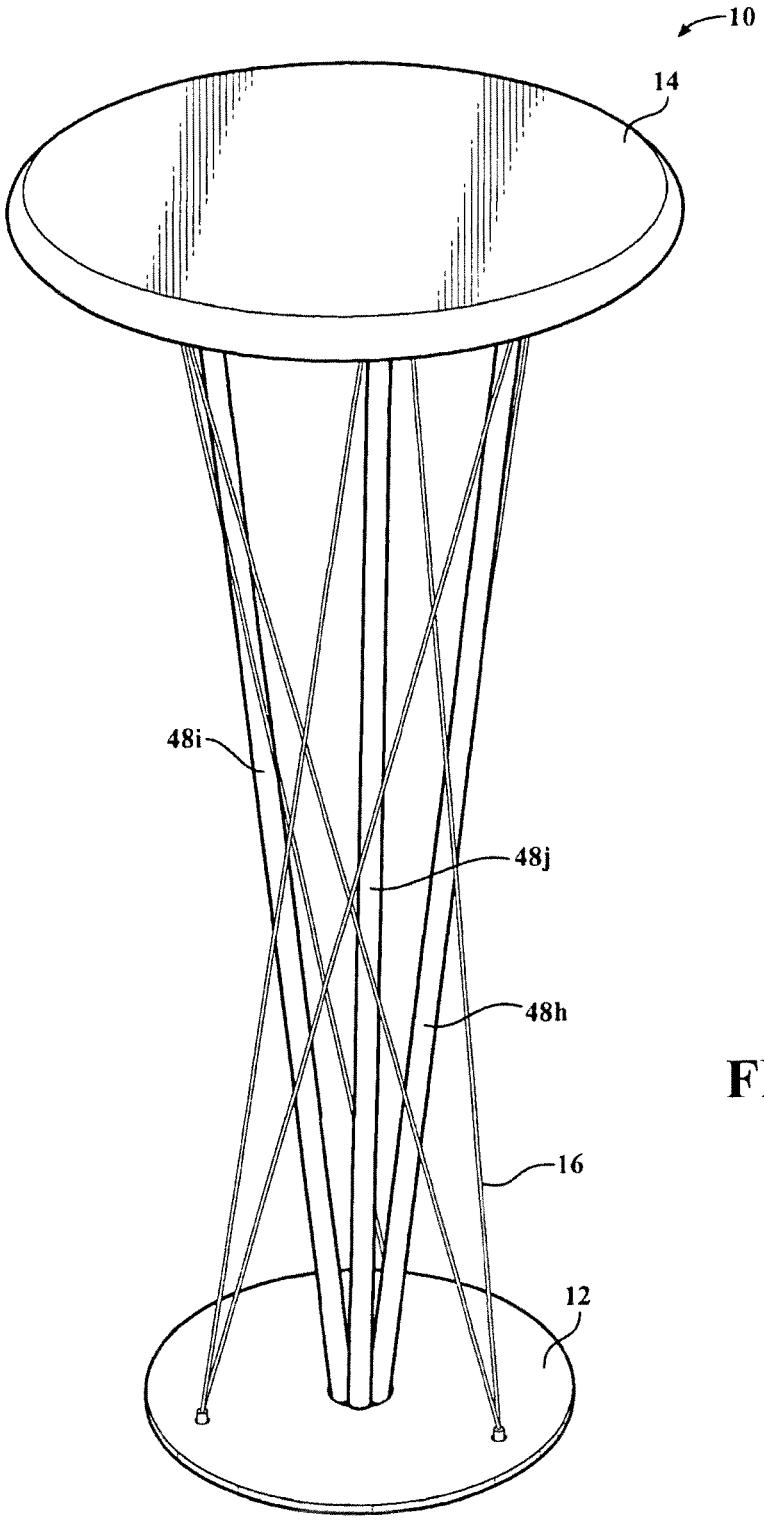
FIG. 10 is a perspective view of a third alternative arrangement of the three-point support assembly shown in FIG. 1.

In a third alternative arrangement of the three-point support assembly 10, shown in FIG. 10, the support assembly 10 includes three posts 48*h*, 48*i*, 48*j* that extend at an angle between the first and second members 12, 14. In the present arrangement, the posts 48*h*, 48*i*, 48*j* abut the first member 12 at a central position. The posts 48*h*, 48*i*, 48*j* diverge outwardly from the central position and abut the second member 14 adjacent the fourth, fifth and sixth connection locations 72, 74, 76.

Figure 13:
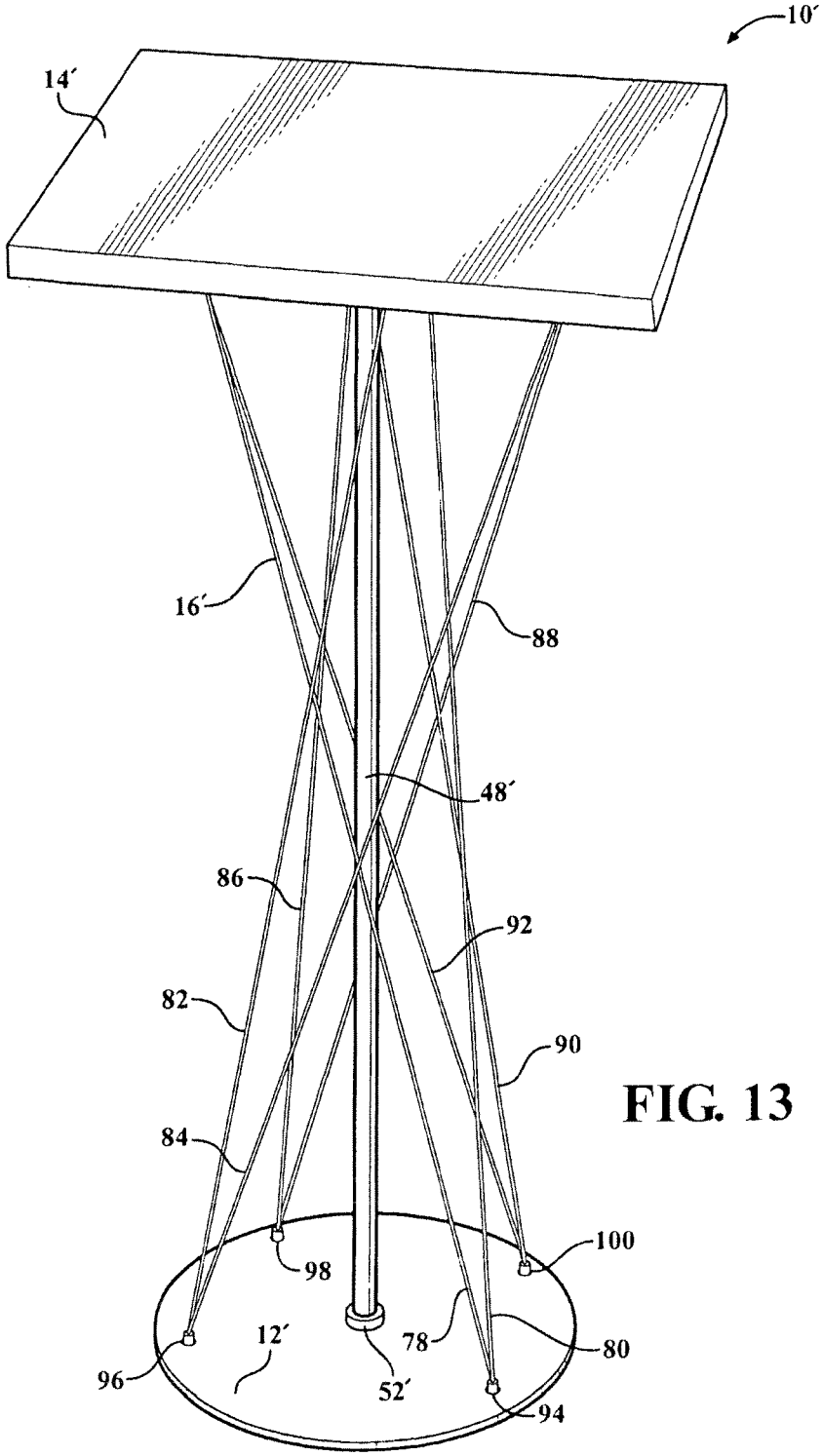
FIG. 13 is a perspective view of a four-point support assembly according to another embodiment of the invention.
Figure 14:
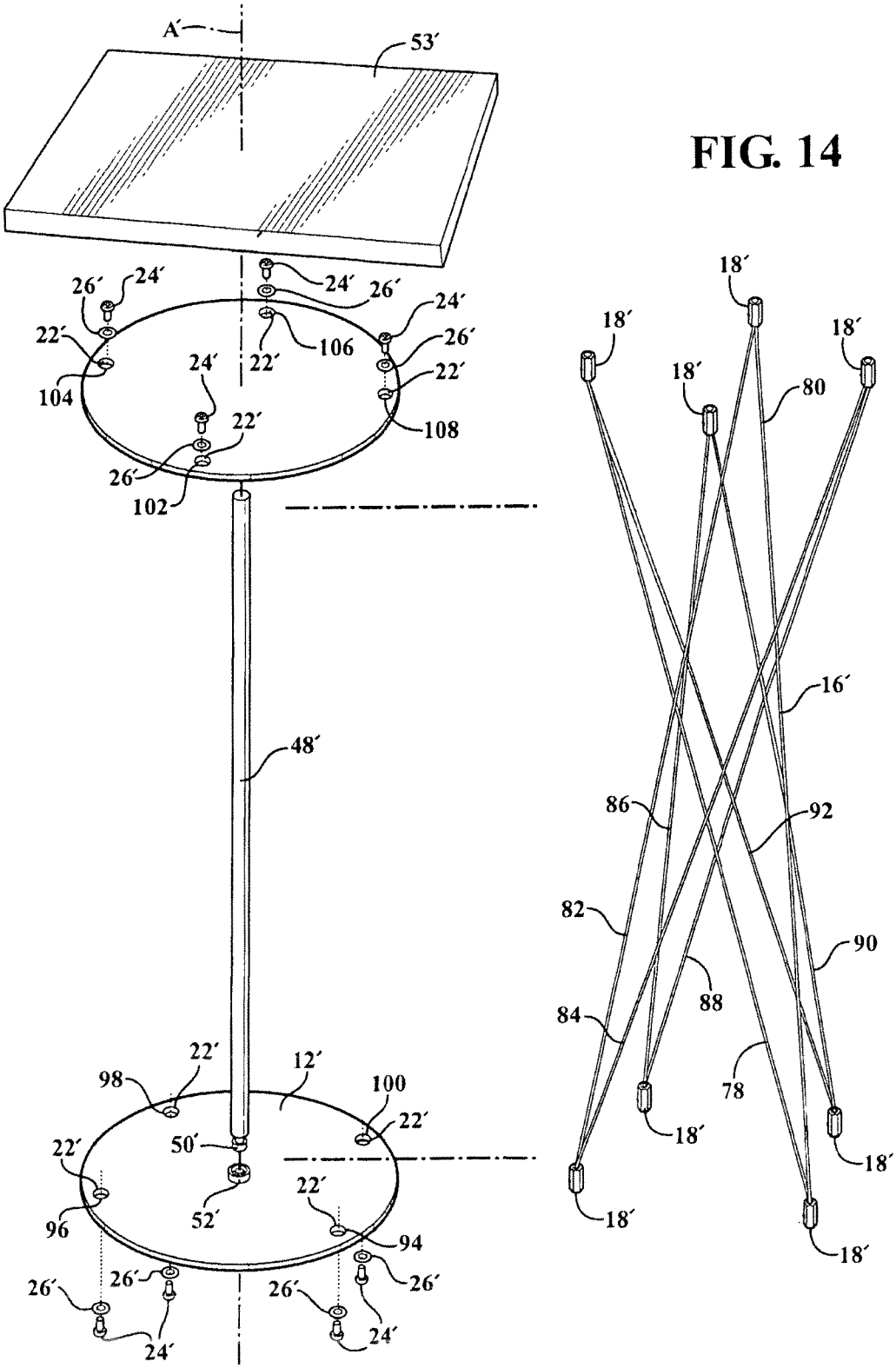
FIG. 14 is an exploded view of the four-point support assembly shown in FIG. 13.

Referring to FIGS. 13 and 14, wherein like primed reference numbers represent similar elements as those described above, in a second embodiment of the invention the support assembly 10' is a four-point system, wherein the cable 16' is connected to each of the first and second members 12', 14' at four separate points, thus creating eight cable sections extending between the first and second members 12', 14' with two cable sections at each connection location. In other words, the cable 16' includes eight cable sections, namely, a first cable section 78, a second cable section 80, a third cable section 82, a fourth cable section 84, a fifth cable section 86, a sixth cable section 88, a seventh cable section 90, and an eighth cable section 92. Each one of the eight cable sections 78, 80, 82, 84, 86, 88, 90, 92 is equal in length such that the first and second 12', 14' members are generally parallel. It is appreciated that each cable section may be a separate cable without varying from the scope of the invention.

The first member 12' includes first, second, third and fourth connection locations 94, 96, 98, 100. The first, second, third and fourth connection locations 94, 96, 98, 100 are angularly spaced apart. More specifically, the first, second, third and fourth connection locations 94, 96, 98, 100 are equally angularly spaced around a center point of the first member 12' such that adjacent connection locations are approximately ninety (90) degrees apart. Similarly, the second member 14' includes fifth, sixth, seventh and eighth connection locations 102, 104, 106, 108. The fifth, sixth, seventh and eighth connection locations 102, 104, 106, 108 are angularly spaced apart. More specifically, the fifth, sixth, seventh and eighth connection locations 102, 104, 106, 108 are equally angularly spaced around a center point of the second member 14' such that adjacent connection locations are approximately ninety (90) degrees apart.

The post 48' extends between the first and second members 12', 14' and defines the first axis A' that is centered relative to the first and second members 12', 14'. In the second embodiment, the second member 14' is rotated about the first axis A' relative to the first member 12' such that the fifth, sixth, seventh and eighth connection locations 102, 104, 106, 108 on the second member 14' are aligned generally between the first, second, third and fourth connection locations 94, 96, 98; 100 on the first member 12'. In other words, the fifth, sixth, seventh and eighth connection locations 102, 104, 106, 108 on the second member 14' are offset about forty-five (45) degrees from the first, second, third and fourth connection locations 94, 96, 98, 100 on the first member 12'.

Beginning with the first cable section 78, opposite ends are fixedly secured to the first and second members 12', 14' at the first and sixth connection locations 94, 104, respectively. Opposite ends of the second cable section 80 are fixedly secured to the first and second members 12', 14' at the first and seventh connection locations 94, 106, respectively. Opposite ends of the third cable section 82 are fixedly secured to the first and second members 12', 14' at the second and seventh connection locations 96, 106, respectively. Opposite ends of the fourth cable section 84 are fixedly secured to the first and second members 12', 14' at the second and eighth connection locations 96, 108, respectively. Opposite ends of the fifth cable section 86 are fixedly secured to the first and second members 12', 14' at the third and fifth connection locations 98, 102, respectively. Opposite ends of the sixth cable section 88 are fixedly secured to the first and second members 12', 14' at the third and eighth connection locations 98, 108, respectively. Opposite ends of the seventh cable section 90 are fixedly secured to the first and second members 12', 14' at the fourth and fifth connection locations 100, 102, respectively. Finally, opposite ends of the eighth cable section 92 are fixedly secured to the first and second members 12', 14' at the fourth and sixth connection locations 100, 104, respectively.

The arrangement of the connection locations 94, 96, 98, 100, 102, 104, 106, 108 is such that each cable section 78, 80, 82, 84, 86, 88, 90, 92 crosses by the post 48' as the cable sections 78, 80, 82, 84, 86, 88, 90, 92 extend between the first and second members 12', 14'. Further, the cable sections 78, 80, 82, 84, 86, 88, 90, 92 form a triangulated pattern that is symmetrical about the first axis A' and carry equal tensile loads that are evenly distributed around the respective perimeters of the first and second members 12', 14'.

Figure 15:
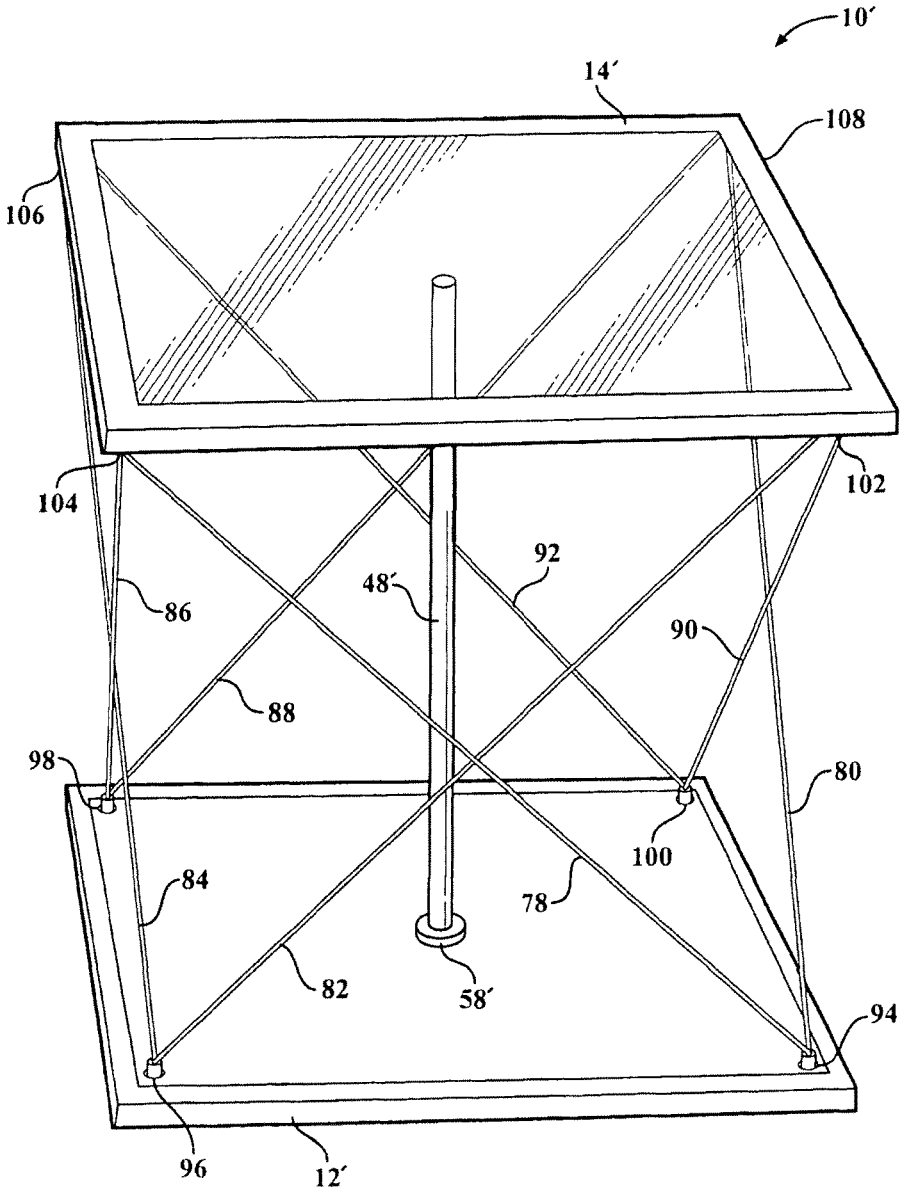
FIG. 15 is a perspective view of a first alternative arrangement of a four-point support assembly.

In a first alternative arrangement of the four-point support assembly 10', shown in FIG. 15, the first and second members 12', 14' are oriented such that the first, second, third and fourth connection locations 94, 96, 98, 100 on the first member 12' and the fifth, sixth, seventh and eighth connection locations 102, 104, 106, 108 on the second member 14' are respectively aligned along axes that are parallel with the first axis A'. More specifically, the second member 14' is generally square and is configured so that the fifth, sixth, seventh and eighth connection locations 102, 104, 106, 108 are positioned at corners thereof. In other words, each edge of the second member 14' includes two connection locations.

Beginning with the first cable section 78, opposite ends are fixedly secured to the first and second members 12', 14' at the first and sixth connection locations 94, 104, respectively. Opposite ends of the second cable section 80 are fixedly secured to the first and second members 12', 14' at the first and eighth connection locations 94, 108, respectively. Opposite ends of the third cable section 82 are fixedly secured to the first and second members 12', 14' at the second and fifth connection locations 96, 102, respectively. Opposite ends of the fourth cable section 84 are fixedly secured to the first and second members 12', 14' at the second and seventh connection locations 96, 106, respectively. Opposite ends of the fifth cable section 86 are fixedly secured to the first and second members 12', 14' at the third and sixth connection locations 98, 104, respectively. Opposite ends of the sixth cable section 88 are fixedly secured to the first and second members 12', 14' at the third and eighth connection locations 98, 108, respectively. Opposite ends of the seventh cable section 90 are fixedly secured to the first and second members 12', 14' the fourth and fifth connection locations 100, 102, respectively. Finally, opposite ends of the eighth cable section 92 are fixedly secured to the first and second members 12', 14' at the fourth and seventh connection locations 100, 106, respectively.

Figure 16:
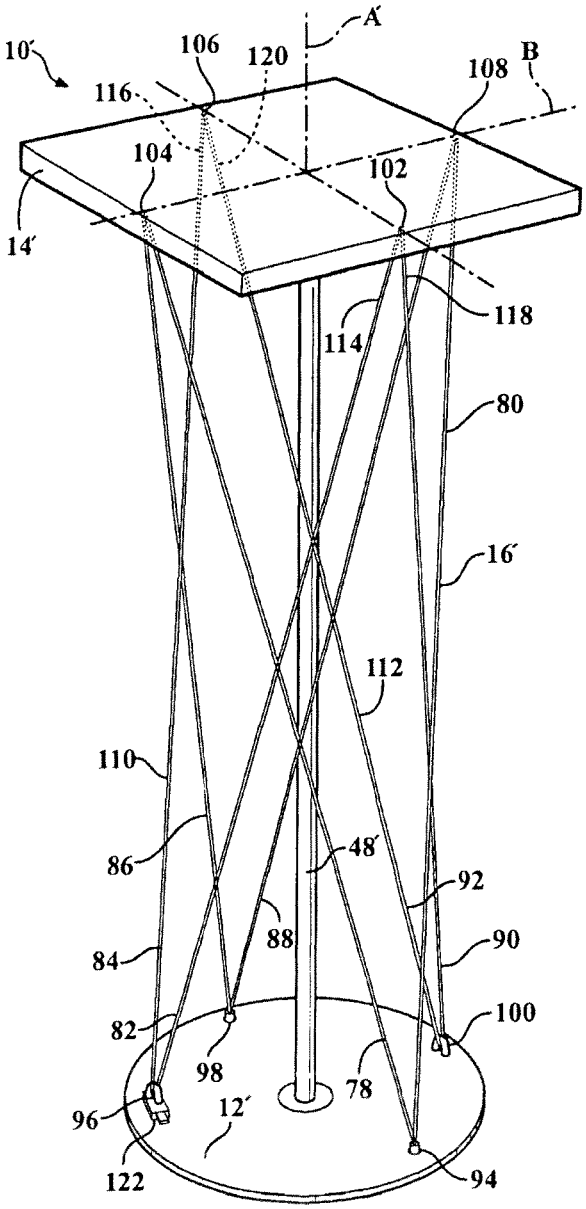
FIG. 16 is a perspective view of a second alternative arrangement of a four-point support assembly.
Figure 17:
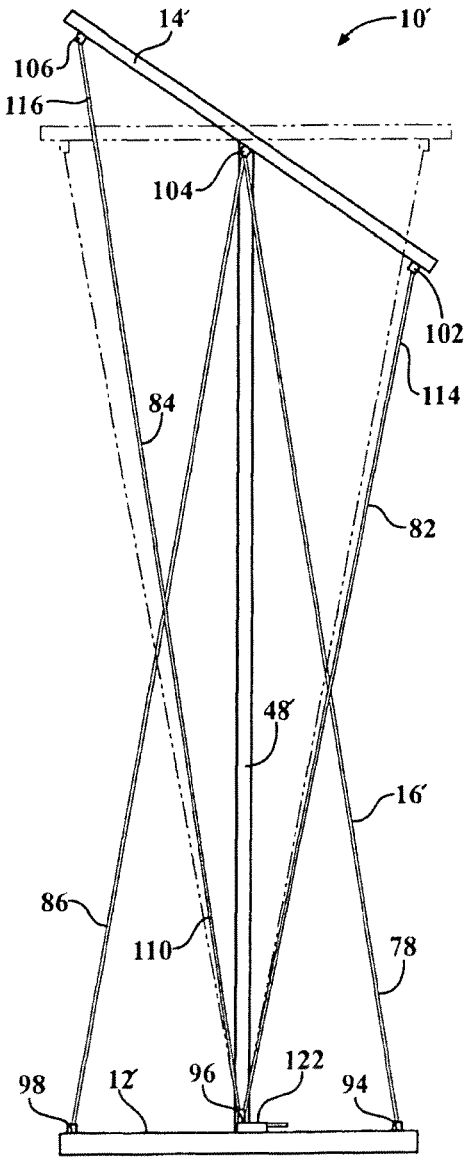
FIG. 17 is a side view of the second alternative arrangement of the four-point support assembly shown in FIG. 16.

In a second alternative arrangement of the four-point support assembly 10', shown in FIGS. 16 and 17, the second member 14' is tiltable about a pivot axis B that is generally perpendicular to the first axis A'. In the embodiment shown, the second member 14' is generally square and is configured so that the fifth, sixth, seventh and eighth connection locations 102, 104, 106, 108 are positioned at midpoints along each edge of the second member 14'. In other words, each edge of the second member 14' includes one connection location. The first and second members 12', 14' are oriented such that the first and fifth connection locations 94, 102 are generally aligned. The second and sixth connection locations 96, 104 are generally aligned. The third and seventh connection locations 98, 106 are generally aligned. The fourth and eighth connection locations 100, 108 are generally aligned.

The third and fourth cable sections 82, 84 are a single continuous cable that forms a first adjustable cable 110. Similarly, the seventh and eighth cable sections 90, 92 are a single continuous cable that forms a second adjustable cable 112. The first, second, fifth and sixth cable sections 78, 80, 86, 88 may each be separate cables.

Beginning with the first cable section 78, opposite ends are fixedly secured to the first and second members 12', 14' at the first and sixth connection locations 94, 104, respectively. Opposite ends of the second cable section 80 are fixedly secured to the first and second members 12', 14' at the first and eighth connection locations 94, 108, respectively. Opposite ends of the fifth cable section 86 are fixedly secured to the first and second members 12', 14' at the third and sixth connection locations 98, 104, respectively. Opposite ends of the sixth cable section 88 are fixedly secured to the first and second members 12', 14' at the third and eighth connection locations 98, 108, respectively.

Referring to the first adjustable cable 110, a first end 114 is fixedly secured to the second member 14' at the fifth connection location 102 and a second end 116 is fixedly secured to the second member 14' at the seventh connection location 106. The first adjustable cable 110 is slidably coupled between the first and second ends 114, 116 to the first member 12' at the second connection location 96. Similarly, referring to the second adjustable cable 112, a first end 118 is fixedly secured to the second member 14' at the fifth connection location 102 and a second end 120 is fixedly secured to the second member 14' at the seventh connection location 106. The second adjustable cable 112 is slidably coupled between the first and second ends 118, 120 to the first member 12' at the fourth connection location 100.

A first lock mechanism 122 is provided at the second connection location 96. The first lock mechanism 122 is selectively actuated between a locked condition and an unlocked condition. In the locked condition, the first adjustable cable 110 is prevented from sliding relative to the first member 12'. In the unlocked condition, the first adjustable cable 110 is allowed to slide relative to the first member 12' thereby allowing the second member 14' to tilt about the pivot axis B relative to the first member 12. The second member 14' can be positioned and locked at any of a plurality of tilted positions.

A second lock mechanism (not shown) may be provided at the fourth connection location 100 to selectively lock and unlock the second adjustable cable 112. In addition, the second lock mechanism may be independently actuated between the locked and unlocked conditions or operatively coupled with the first lock mechanism such that both the first and second lock mechanism actuate between the locked and unlocked conditions simultaneously.

The invention has been described in an illustrative manner, and it is to be understood that the terminology, which has been used, is intended to be in the nature of words of description rather than of limitation. Many modifications and variations of the present invention are possible in light of the above teachings. It is, therefore, to be understood that within the scope of the appended claims, the invention may be practiced other than as specifically described.

What is claimed:

1. A support assembly comprising:

a first member;

a second member separate and spaced apart from said first member;

a third member securing said first and second members together; and a fourth member extending between said first and second members, said fourth member forcing said first and second members apart to provide a tensile force in said third member and a compressive three in said fourth member, thereby stabilizing said support assembly, wherein the fourth member defines a first axis, the third member includes at least one section, the at least one section having one end secured to the first member and an opposed end secured to the second member, and a second axis that passes through both the one end and the opposed end is non-parallel with respect to the first axis.

2. A support assembly as set forth in claim 1 wherein said third member is flexible.

3. A support assembly comprising:

a first member;

a second member separate and spaced apart from said first member;

a third member fixedly secured to said first member and said second member; and a fourth member extending linearly between said first member and said second member, wherein a length of said fourth member is selectively adjustable and increasing said length of said fourth member provides a tensile force in said third member and a compressive force in said fourth member, thereby stabilizing said support assembly, wherein the fourth member defines a first axis, the third member includes at least one section, the at least one section having one end secured to the first member and an opposed end secured to the second member, and a second axis that passes through both the one end and the opposed end is non-parallel with respect to the first axis.

4. A support assembly as set forth in claim 3 wherein said third member is flexible.

5. A support assembly as set forth in claim 3 wherein increasing said length of said fourth member increases the stability of said support assembly.

6. A support assembly as set forth in claim 3 wherein said first and second members are generally parallel.

7. A support assembly as set forth in claim 3 wherein said first and second members are generally non-parallel.

8. A support assembly as set forth in claim 3 including a plurality of said fourth members extending linearly between said first and second members, wherein each of said plurality of said fourth members is generally parallel.

9. A support assembly as set forth in claim 3 including a plurality of said fourth members extending between said first and second members, wherein each of said plurality of said fourth members is non-parallel.

10. A support assembly as set forth in claim 3 wherein said third member is fixedly secured to said first member at a first plurality of connection locations, said first plurality or connection locations positioned symmetrically about said first member, and said third member is fixedly secured to said second member at a second plurality of connection locations, said second plurality of connection locations positioned symmetrically about said second member.

11. A support assembly as set forth in claim 3 wherein said third member is fixedly secured to said first member at first, second and third connection locations and said third member is fixedly secured to said second member at fourth, fifth and sixth connection locations.

12. A support assembly as set forth in claim 11 wherein said first, second and third connection locations are equally angularly spaced apart and said fourth, fifth and sixth connection locations are equally angularly spaced apart.

13. A support assembly comprising:

a first member;

a second member separate and spaced apart from said first member;

a third member securing said first and second members together; and a fourth member extending between said first and second members, said fourth member forcing said first and second members apart to provide a tensile force in said third member and a compressive farce in said fourth member, thereby stabilizing, said support assembly, wherein said third member is fixedly secured to said first member at first, second and third connection locations and said third member is fixedly secured to said second member at fourth, fifth and sixth connection locations, and said third member includes first, second, third, fourth, fifth and sixth sections, said first section is fixedly secured to said first member at said first connection location and said second member at said fifth connection location, said second section is fixedly secured to said first member at said first connection location and said second member at said sixth connection location, said third section is fixedly secured to said first member at said second connection location and said second member at said fourth connection location, said fourth section is fixedly secured to said first member at said second connection location and said second member at said sixth connection location, said fifth section is fixedly secured to said first member at said third connection location and said second member at said fourth connection location, and said sixth section is fixedly secured to said first member at said third connection location and said second member at said fifth connection location.

14. A support assembly as set thrill in claim 13 wherein each of said first, second, third, fourth, fifth and sixth sections have equal lengths.

15. A support assembly as set forth in claim 3 wherein said third member is fixedly secured to said first member at first, second, third and fourth connection locations and said third member is fixedly secured to said second member at fifth, sixth, seventh and eighth connection locations.

16. A support assembly as set forth in claim 15 wherein said first, second, third and fourth connection locations are equally angularly spaced apart and said fifth, sixth, seventh and eighth connection locations are equally angularly spaced apart.

17. A support assembly as set forth in claim 16 wherein said first, second, third and fourth connection locations are offset angularly about forty-five degrees relative to said fifth, sixth, seventh and eighth connection locations.

18. A support assembly as set forth in claim 15 wherein said third member includes first, second, third, fourth, fifth, sixth, seventh and eighth sections, said first section is fixedly secured to said first member at said first connection location and said second member at said sixth connection location, said second section is fixedly secured to said first member at said first connection location and said second member at said seventh connection location, said third section is fixedly secured to said first member at said second connection location and said second member at said seventh connection location, said fourth section is fixedly secured to said first member at said second connection location and said second member at said eighth connection location, said fifth section is fixedly secured to said first member at said third connection location and said second member at said fifth connection location, said sixth section is fixedly secured to said first member at said third connection location and said second member at said eighth connection location, said seventh section is fixedly secured to said first member at said fourth connection location and said second member at said fifth connection location, and said eighth section is fixedly secured to said first member at said fourth connection location and said second member at said sixth connection location.

19. A support assembly as set forth in claim 3 wherein said second member is selectively pivotal relative to said first member.

20. A support assembly as set forth in claim 19 wherein at least a portion of said third member is selectively slidably coupled to said first member, thereby allowing pivotal movement of said second member relative to said first member.

21. A support assembly as set forth in claim 20 wherein said third member includes first, second, third, fourth, fifth, sixth, seventh and eighth sections, said first section is fixedly secured to said first member at a first connection location and said second member at a sixth connection location, said second section is fixedly secured to said first member at said first connection location and said second member at an eighth connection location, said fifth section is fixedly secured to said first member at a third connection location and said second member at said sixth connection location, said sixth section is fixedly secured to said first member at said third connection location and said second member at said eighth connection location, said third and fourth sections form a first adjustable member and said seventh and eighth sections form a second adjustable member, a first end of said first adjustable member is fixedly secured to said second member at a fifth connection location and a second end is fixedly secured to said second member at a seventh connection location, a first end of said second adjustable member is fixedly secured to said second member at said fifth connection location and a second end is fixedly secured to said second member at said seventh connection location, said first adjustable member is selectively slidably coupled between said first and second ends of said first adjustable member to said first member at a second connection location and said second adjustable member is selectively slidably coupled between said first and second ends of said second adjustable member at a fourth connection location, thereby allowing selective sliding movement of said first and second adjustable members relative to said first member.

22. The support assembly as set forth in claim 1 wherein the at least one section extends linearly between the one end and the opposed end.

23. The support assembly as set forth in claim 1 wherein each of the first member and the second member include a connection locations, where n is a variable that is as positive integer, the third member includes 2n sections, each section having, the one end connected to a connection location of the first member and the opposed end connected to a connection location of Inc second member, and each connection location receives an end of two different sections.

* * * * *